United States Patent [19]

Burkstrand et al.

[11] Patent Number: 4,951,436

[45] Date of Patent: Aug. 28, 1990

[54] CEILING RUNNER

[76] Inventors: Lowell E. Burkstrand, Rte. No. 1, Box 170, Braham, Minn. 55006; George W. Burkstrand, 4335 - 4th St., Columbia Heights, Minn. 55421

[21] Appl. No.: 84,998

[22] Filed: Aug. 13, 1987

Related U.S. Application Data

[63] Continuation-in-part of Ser. No. 27,067, Mar. 7, 1987, Pat. No. 4,850,169, which is a continuation-in-part of Ser. No. 848,642, Apr. 7, 1986.

[51] Int. Cl.[5] ..... E04B 2/78

[52] U.S. Cl. ..... 52/241; 52/238.1; 52/348

[58] Field of Search ..... 52/238.1, 241, 242, 52/243, 346, 347, 348

[56] References Cited

U.S. PATENT DOCUMENTS

| | | | |
|---|---|---|---|
| 1,217,603 | 2/1963 | Jester . | |
| 1,446,916 | 2/1923 | McElheny | 52/349 |
| 1,563,651 | 12/1925 | Pomerantz | 52/348 |
| 1,729,439 | 9/1929 | Gordee | 52/241 |
| 1,982,104 | 11/1934 | Holdsworth | 52/ |
| 2,078,491 | 1/1982 | Graham | 72/46 |
| 2,079,635 | 8/1975 | Sharp | 189/34 |
| 2,105,771 | 10/1981 | Holdsworth | 72/46 |
| 2,173,721 | 9/1939 | McGee | 52/348 |
| 2,371,921 | 3/1979 | Tucker | 189/34 |
| 2,676,483 | 4/1983 | Nelsson | 72/46 |
| 2,699,669 | 4/1971 | Nelsson | 72/46 |
| 2,834,267 | 9/1962 | Beebe | 94/30 |
| 2,909,251 | 10/1959 | Nelsson | 52/481 |
| 3,027,605 | 5/1982 | Nelsson | 20/4 |
| 3,320,710 | 5/1967 | Byssing | 52/241 |
| 3,332,188 | 1/1982 | Schaefer | 52/349 |
| 3,349,529 | 10/1967 | Byssing | 52/ |
| 3,461,638 | 12/1989 | Balinski | 52/238 |
| 3,465,488 | 3/1989 | Miller | 52/481 |
| 3,986,314 | 10/1976 | Moeller | 52/241 |
| 3,998,027 | 4/1987 | Wendt | 52/716 |
| 4,018,020 | 8/1969 | Sauer et al. | 52/241 |
| 4,448,004 | 3/1972 | Thorsell | 52/486 |
| 4,461,135 | 9/1972 | Anderson et al. | 52/827 |

FOREIGN PATENT DOCUMENTS 34318 2/1981 Finland .

*Primary Examiner*—Michael Safavi
*Attorney, Agent, or Firm*—Schroeder & Siegfried

[57] ABSTRACT

A ceiling runner is disclosed that includes a ceiling portion and a depending portion formed in a U-shaped cross section with a pair of upstanding leg elements interconnected with a web portion and on the opposite end of the leg portion, edge portions extending away from each other an amount equal to the width of a margin on each side of the runner. Another version of the runner has the edge portions tipped over so that they cap the upper end of the vertical wallboard panels and provide a finishing touch around the periphery of the room. A plurality of cut-out portions are formed in the web portion with 8" centers for use in 16" or 24" spacing of studs and to accommodate unevenly cut studs that extend upwardly through the cut-out portions.

1 Claim, 2 Drawing Sheets

CEILING RUNNER

FIELD OF THE INVENTION

This invention relates to the field of wallboard construction trim and more particularly to the field of a ceiling runner used to secure the wallboard and ceiling elements at the ceiling level with a trim appearance.

BRIEF DESCRIPTION OF THE PRIOR ART

At the present time, walls that are built to join acoustical ceilings have a rather poor looking joint where the wall and ceilings form an intersection. As presently constructed, walls and ceilings appear to have an unfinished appearance at the corners and it is highly desirable to provide a finished construction. Various attempts have been made to solve this particular problem and one of these is found in U.S. Pat. No. 3,998,027 entitled DECORATIVE RUNNER AND WALL wherein a cap or a similar structure may be added or removed from the appearance of the flange material used at the ceiling level. To this end, a variety of decorative surfaces include a variety of painted colors, textures, or exposure to the metal, such as aluminum or stainless steel.

U.S. Pat. No. 3,027,605 to Nelsson entitled HOLLOW WALL CONSTRUCTION in which part of the upper ceiling runner is exposed attempts to solve the problem but does not form a margin around the ceiling and thus, provide the finished appearance that is needed.

U.S. Pat. No. 4,461,135 entitled WALLBOARD TRIM APPARATUS discloses a combination of clip elements that may be secured to the vertical wallboard and to which various forms of trim strips are secured to give some form of finished appearance, but the combination still falls short of providing the finished border that is needed.

U.S. Pat. No. 2,105,771 entitled WALL CONSTRUCTION discloses a base member and top member that will secure sheet metal studs into a wall but lacks stability at both the top and bottom where employed.

BRIEF SUMMARY OF THE INVENTION

The present invention provides a method and apparatus for supporting the wallboards at the ceiling level while providing a finished strip that extends along the ceiling to produce a border around the room and thus, a finished appearance at the ceiling and wall corner. The ceiling runner is also constructed so that cut-out portions are established spatially along the runner at 8" centers to accommodate a stud wall that has studs on either 16" or 24" centers. Additionally, where studs are not required to be secured at their uppermost position this practice may be avoided. Another version of the runner has the edge portions turned over so that they cap the upper end of the vertical wallboard panels and provide a finishing touch around the periphery of the room. As an added feature, when the studs are being set up during the assembly period, there is no need to measure the length of each to insure that all of the studs are of uniform length as long as they extend above the runner.

It is therefore a general object of this invention to provide an improvement in a ceiling runner.

It is still another object of this invention to provide a ceiling runner that eliminates cutting of the studs to a fixed length.

It is still another object of this invention to eliminate labor and the error of laying out studs at the ceiling track.

It is still a further object of this invention to provide a ceiling runner that avoids fastening the studs at the top of the track unless so desired.

It is still another object of this invention to provide a means of forming a trim margin where the ceiling joins the side walls.

It is yet another object of this invention to provide a means of finishing the ceiling and walls without attachment of the trim members.

It is still another object of this invention to eliminate the high cost of building walls above an acoustical ceiling grid that is in place.

It is yet another object of this invention to provide a means of setting up studs to avoid a domino effect while establishing a stud wall.

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 4:
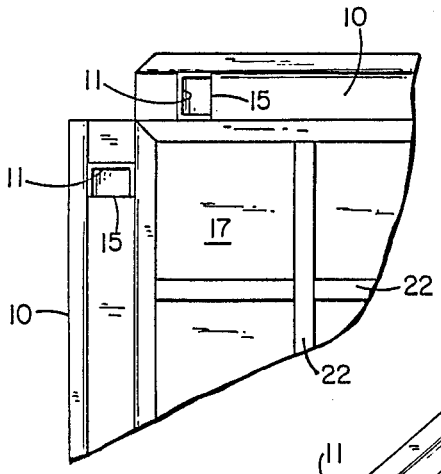
FIG. 4 is an inverted view of a room corner disclosing the invention.
Figure 1:
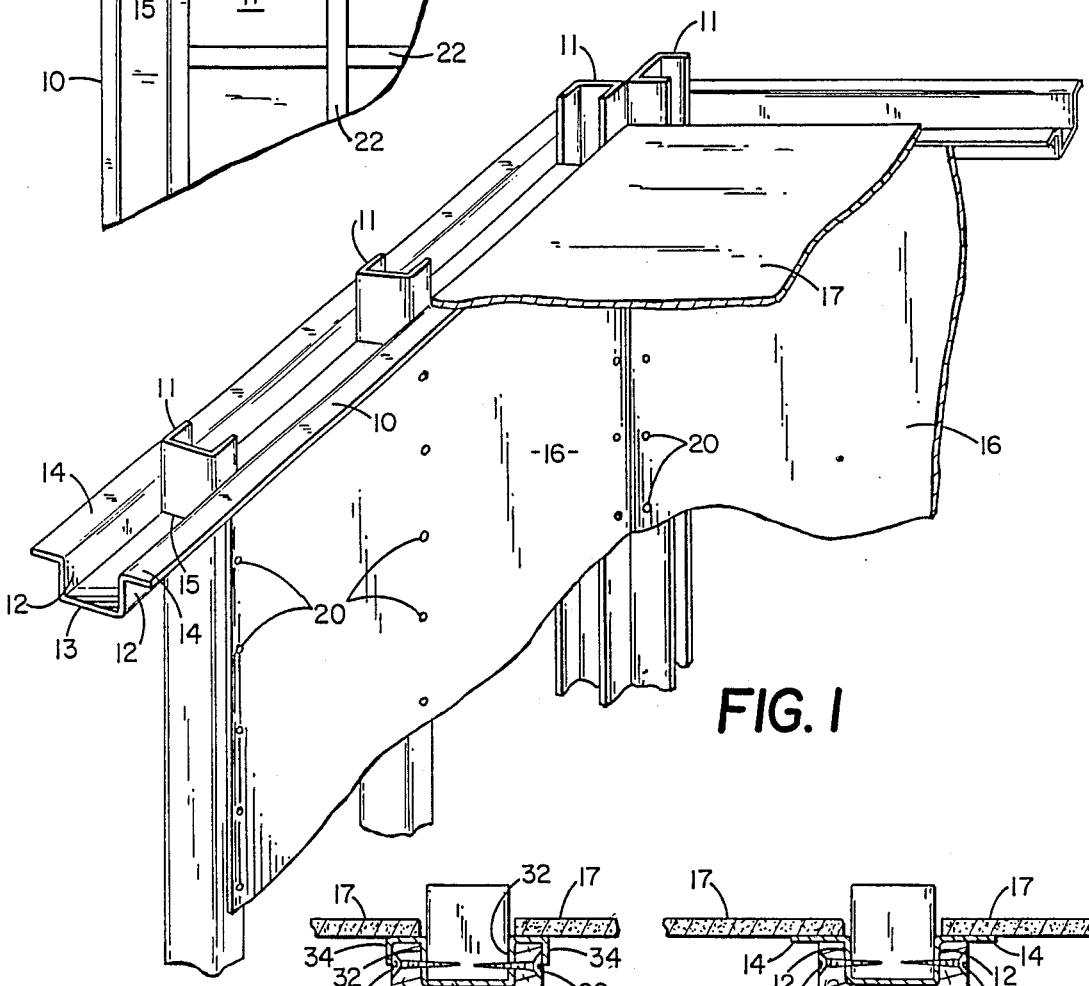
FIG. 1 is a perspective section of the invention disclosing its use with a stud wall and ceiling tile.

A ceiling runner 10 formed generally of 25 gauge sheet metal extends along a wall which is formed of a plurality of sheet metal studs 11. Runner 10 has a pair of upstanding legs 12 that are joined at their bottom with a web portion 13 and at the top of each leg 12 is an edge portion 14. As a general matter the upstanding legs 12 are of shorter dimension than the web portion that separates them at the bottom. Studs 11 extend through cut-out portions 15 formed in web 13. The cut-out portions 15 are formed on 8" centers so that the stud walls may be erected on 16" or 24" centers without further measuring when the wall is being formed.

Each of the edge portions extend away from the upstanding leg elements approximately 1½ inches so that after a pair of wallboards 16 are placed against studs 11, there remains a ¾ inch exposed portion of edge portion 14 that forms a proper margin or border around the interior of the room where the ceiling joins wall 16. Ceiling 17 may take on several different shapes such as ceiling tile or large sheets of wallboard or other suitable acoustic material to serve as the ceiling. It will be noted that the ceiling blocks do not have to have any particular spacing from the studs as long as the edge portions cover the end of the ceiling material.

Figure 5:
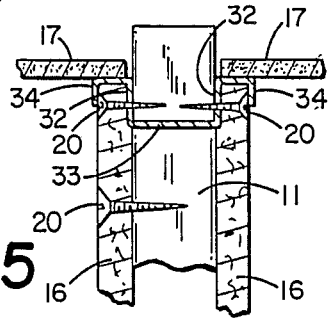
FIG. 5 is an alternate version of the invention.
Figure 2:
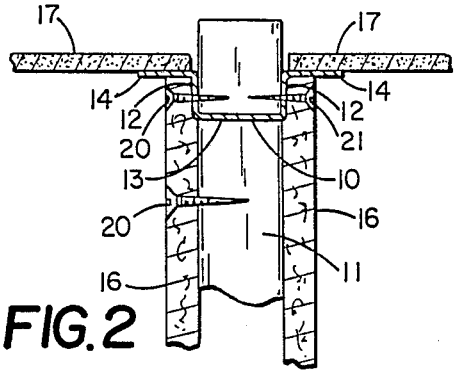
FIG. 2 is a side elevation section of the invention.
Figure 3:
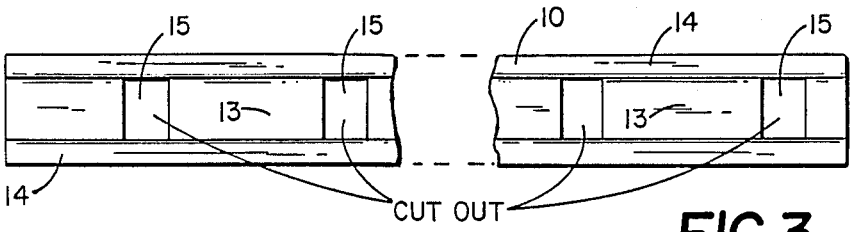
FIG. 3 is a top-plan view of the ceiling runner.

Another version of the runner 33 is disclosed in FIG. 5 where an edge portion 34 is turned over the vertical wall panel 16 and provides a finishing touch along the periphery of the room. It will be found that combinations of one form of edge portions 14 or 34 may be more suitable for one finish than another.

Where it is desirable, fasteners such as screws 20 may be used to secure the wallboard panel 16 to studs 11. In like manner, sheet metal screws 21 may be used to secure the ceiling runner to studs 11.

FIG. 4 shows a grid pattern made up of the ceiling runners 10 and an overhanging lattice network 22 for holding ceiling tile or blocks 17.

Once installed, our ceiling runner provides a marked improvement in appearance. The aesthetic effect which is obtained as a result thereof is a vast improvement over the various trims which have heretofore been utilized. The laterally extending edge portions are appropriately 1½ inches wide and since most wallboard sold today is ⅝ or ½ inch in thickness, such portions extend outwardly beyond the wallboard and provide the desired revealed marginal edge which constitutes the marked improvement in appearance.

Figure 6:
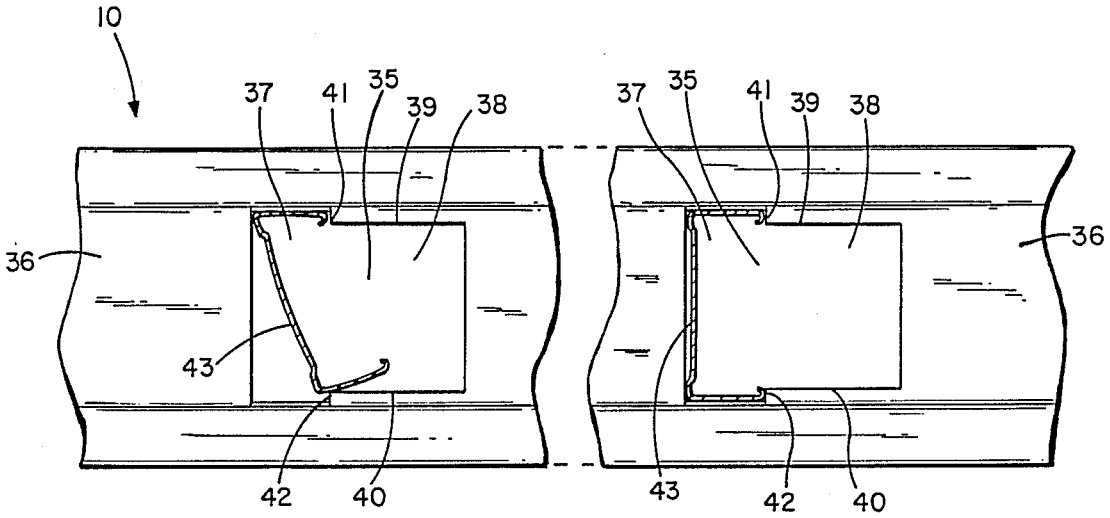
FIG. 6 is a plane view of a section of one of our ceiling runners with an intermediate portion thereof broken away.
Figure 7:
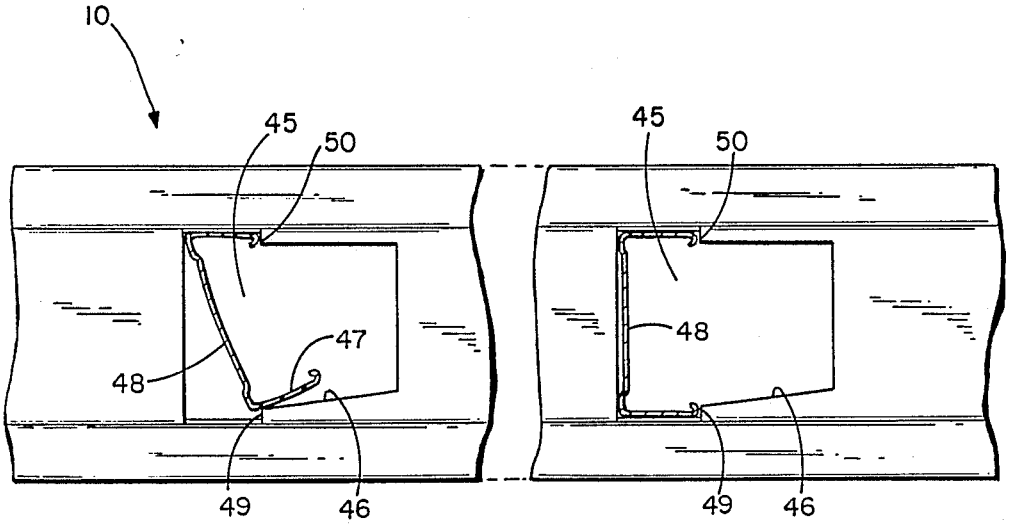
FIG. 7 is a plan view of a section of preferred form of one of our ceiling runners with an intermediate portion broken away.

FIG. 6 and FIG. 7 have been added to the drawings of our original application, which is the basis for this application, in order to better illustrate one manner in which the studs may be received and secured within our improved ceiling runner. In addition, claims have been added herein in order to more adequately protect our invention.

FIG. 6 illustrates one form of the ceiling runner wherein the openings 35 are elongated and extend longitudinally of the web 36. As shown, each opening can be viewed as a pair of merged rectangular openings one 37 of which has slightly greater transverse dimensions than the other 38. The side walls 39 and 40 of the latter are parallel and each has a corner consisting of a retaining tab 41 and on opposite corner or locking detent 42. As shown, the tab 41 and detent 42 hold the stud 43 in fixed position relative to the runner 10, once it has been inserted into the opening 35 and snapped into position as hereinafter described.

In FIG. 6 the stud 43 is shown in the opening 35 at the left, as it is inserted into the opening and is twisted about its longitudinal axis; preparatory to completing the twist and thereby snapping the stud into locked or fixed position within the opening 37, the latter position being shown at the right in FIG. 6. It will be seen that in so doing, the base portion of the leg of the stud 43 which engages the side wall 40 of opening 38 is cammed inwardly thereby, which permits that leg to slide by the detent 42 and snap into locked position as shown at the right of FIG. 6. It will be seen that thereafter the detent 42 and the retaining tab 41 hold the stud 43 in fixed position relative to the channel member 10.

FIG. 7 shows a preferred form of opening for receiving and locking studs within the ceiling runner 10. As shown, the opening 45 is similar to opening 35 of FIG. 6 except that it has a beveled camming surface 46. This surface 46 functions to more easily cam the leg 47 of the stud 48 inwardly, in order to permit the base portion of the leg 47 to slide by the detent 49. Once this has been accomplished the further twisting of the stud 48 about its longitudinal axis will cause the stud 48 to snap into locked position whereat the detent 49 and the retaining tab 50 will maintain the stud in locked position relative to the channel member 10.

While we have filed a Continuation-In-Part of the parent application herein under Ser. No. 06/027,067 entitled IMPROVED CEILING RUNNER as of Mar. 17, 1987, in conjunction with a joint inventor, which application shows an additional form of opening in FIG. 7 thereof, as of the date of filing this application it is not yet known whether that shape of opening is commercially feasible. If it proves to be commercially feasible, that shape which is a modified form of the shape shown in FIG. 7 hereof, may prove to be the preferred mode of opening to be utilized in its commercial form.

Since the filing of the parent application herein, U.S. Pat. Nos. 2,909,251 (Nelson), 2,699,669 (Nelson); and 3,745,732 (Pritchard et al) have been brought to our attention as pertinent prior art. None of these patents, however, contain any suggestion whatever of an edge portion which provides a revealed marginal edge which extends outwardly beyond the wallboard so as to provide a highly improved aesthetic effect such as is disclosed and claimed herein. Our improved ceiling runner, as disclosed and claimed herein, has been widely accepted and acclaimed within the industry because of its highly improved appearance and reduction in cost.

It will, of course, be understood that various changes may be made in the form, details, arrangement and proportions of the parts without departing from the scope of the invention which consists of the matter shown and described herein and set forth in the appended claims.

What is claimed is:

1. A ceiling runner to be extended around the periphery of a room for holding wallboard of predetermined thickness, comprising:

(a) an elongated channel member having a transverse web element and a pair of upstanding leg elements, each one of which extends upwardly from opposite sides of said web element at right angles thereto and each of which has a terminal flange extending in a plane substantially parallel to said web element and having a free edge portion;

(b) said web element having areas thereof cut out at locations spaced along the length of the web element and being constructed and arranged to receive upstanding studs therethrough;

(c) an upright wallboard wall extending along one of said leg elements and having an upper end abutting against the terminal flange supported by said leg element and having an exposed outer surface; and (d) said channel member being constructed and arranged so that said terminal flange of said leg element along which said wall is arranged extends outwardly beyond said exposed outer surface of said wall with the free edge portion of said flange being in a plane immediately above the plane of said upper end of said wall, and being exposed to thereby provide a revealed trim edge thereat.

* * * * *